US008033799B2

(12) United States Patent
Ishikawa

(10) Patent No.: US 8,033,799 B2
(45) Date of Patent: Oct. 11, 2011

(54) COOLING FAN UNIT AND METHOD FOR DRAWING OUT LEAD WIRES THEREOF

(75) Inventor: Kazushi Ishikawa, Kyoto (JP)

(73) Assignee: Nidec Corporation, Kyoto (JP)

( * ) Notice: Subject to any disclaimer, the term of this patent is extended or adjusted under 35 U.S.C. 154(b) by 586 days.

(21) Appl. No.: 12/169,755

(22) Filed: Jul. 9, 2008

(65) Prior Publication Data

US 2010/0008800 A1 Jan. 14, 2010

(51) Int. Cl.
*F04B 35/04* (2006.01)

(52) U.S. Cl. ..... 417/423.14

(58) Field of Classification Search ..... 310/71, 310/416, 67 R; 417/423.14, 354, 423.1
See application file for complete search history.

(56) References Cited

U.S. PATENT DOCUMENTS 7,221,567 B2 * 5/2007 Otsuki et al. ..... 361/695
7,358,631 B2 4/2008 Morishitahara
2005/0180867 A1 8/2005 Takahashi et al.
2006/0280632 A1 12/2006 Sugiyama et al.
2007/0063600 A1 * 3/2007 Fujii et al. ..... 310/71
2007/0099459 A1 5/2007 Otsuki et al.
2007/0280840 A1 12/2007 Sugiyama et al.

* cited by examiner

*Primary Examiner* — Devon C Kramer
*Assistant Examiner* — Bryan Lettman
(74) *Attorney, Agent, or Firm* — Keating & Bennett, LLP

(57) ABSTRACT

A cooling fan unit includes a hook groove locking a plurality of lead wires drawn out of a circuit board and being formed in a wall of a housing in a direction of drawing out the lead wires. The hook groove has a lead wire through path which extends substantially perpendicularly from an end edge of the wall of the housing and a lead wire guide which extends substantially perpendicularly from a bottom of the lead wire through path. At least two of the plurality of lead wires are crossed with each other between the hook groove and a connection portion of the circuit board with respect to the plurality of lead wires, so that at least one second lead wire inhibits displacement of a first lead wire, which is aligned closest to the lead wire through path out of the plurality of lead wires accommodated in the lead wire guide, to a direction of being disengaged from the lead wire through path.

23 Claims, 9 Drawing Sheets

COOLING FAN UNIT AND METHOD FOR DRAWING OUT LEAD WIRES THEREOF

BACKGROUND OF THE INVENTION

1. Field of the Invention

The present invention relates to improvements in a method for locking to and drawing out of a hook groove, which is provided in a housing, a plurality of lead wires which extend out from a circuit board of a cooling fan unit.

2. Description of the Related Art

A cooling fan unit used for cooling an electronic device includes an impeller having a plurality of blades, a motor for rotating the impeller, a circuit board mounting thereon a driver circuit for the motor, and a housing for fixing thereto the motor and the circuit board as well as accommodating therein the impeller. Connected to the circuit board are a plurality of (at least three) lead wires used for power supply and control, and there is attached, at ends of the lead wires, a connector for connection with an electronic device.

In accordance with a type, size, shape and the like of the cooling fan unit, there are various structures adopted for drawing the lead wires of the cooling fan unit out of the circuit board through the housing. There is a simple structure for a relatively small cooling fan unit in which a hook groove for locking the lead wires thereto is formed in an outer wall portion of the housing in a direction of drawing out the lead wires. Described below are examples of such a structure for drawing out lead wires in a conventional cooling fan unit.

FIGS. 8A and 8B are views of a structure for drawing out lead wires in a conventional cooling fan unit. FIG. 8A is a bottom view of the cooling fan unit seen from a side of a base portion in a direction of a central axis, while FIG. 8B is a partially enlarged cross sectional view of an outer wall portion of a housing of the cooling fan unit as seen from a direction of drawing out the lead wires. It is noted that an impeller is not illustrated in FIG. 8A.

A housing 1 of the cooling fan unit includes an outer wall 11, a base 12, and four joining portions 13 which connect the outer wall portion 11 and the base 12 with each other. The base 12 has a substantially cylindrical shape and accommodates therein a motor (not shown) and a circuit board 5. The circuit board 5 is partially exposed at a cutout 121 provided in the base 12. Lead wires 6 are soldered to a lead wire connection portion (including solder lands) which is provided at an area where the circuit board 5 is exposed. The lead wires 6 are attached at other ends thereof to a connector 7 which is used for connection with an electronic device.

There is formed a hook groove 110 in the outer wall 11 of the housing 1 in the direction of drawing out the lead wires. The hook groove 110 includes a lead wire through path 111 and a lead wire guide 112. The lead wires 6 are inserted sequentially one by one starting with a rightmost wire of FIG. 8A into the lead wire through path 111 and are accommodated in the lead wire guide 112.

There is another example of the structure for drawing out lead wires of the conventional cooling fan unit, in which there is provided a rib for guiding and accommodating the lead wires 6 from the connection portion of the circuit board 5 with respect to the lead wires 6 to the outer wall 11 of the housing 1. Further, there is a structure in which one of the joining portions 13 is formed to be wide to function also as a rib for accommodating the lead wires. However, these structures respectively have a drawback such that the wide rib for guiding the lead wires 6 counteracts airflow generated by rotation of the impeller. In order to overcome such a drawback, the conventional example shown in FIG. 8A adopts a structure in which there is provided no guide rib so that the lead wires 6 are exposed to airflow.

When the conventional cooling fan unit shown in FIGS. 8A and 8B is incorporated in an electronic device, one of the lead wires 6 aligned closest to the lead wire through path 111 (the leftmost lead wire in FIGS. 8A and 8B) is likely to be disengaged from the lead wire through path 111 depending on a way of drawing around the lead wires 6 within the electronic device. The lead wire 6 disengaged from the lead wire through path 111 (that is, the hook groove 110) may widely swing due to the airflow, which will cause noise. Further, the disengaged lead wire 6 may be brought into contact with another component within the electronic device to damage coating thereof or to be thermally deteriorated.

Disengagement of one of the lead wires 6 from the hook groove 110 can be prevented by applying an adhesive agent or an adhesive tape so as to block an opening of the lead wire through path 111. However, it is desirable not to perform such work which requires an additional cost and manufacturing step.

SUMMARY OF THE INVENTION

In order to overcome the problems described above, preferred embodiments of the present invention provide a cooling fan unit structured such that lead wires are locked to a hook groove provided in a wall of a housing and are drawn out of the housing, as well as a simple method to prevent disengagement of one of the lead wires from the hook groove.

The cooling fan unit according to a preferred embodiment of the present invention is preferably used for cooling an electronic device, and the fan unit includes: an impeller having a plurality of blades and rotating to generate airflow; a motor rotating the impeller; a circuit board mounting thereon components configuring a circuit to supply the motor with drive current; a housing fixing thereto the motor and the circuit board and accommodating the impeller; and a plurality of lead wires connected to the circuit board and drawn out of the housing; wherein a hook groove which locks the lead wires is formed in a wall of the housing in a direction of drawing out the lead wires, the hook groove has a lead wire through path which extends substantially perpendicularly from an end edge of the wall of the housing and a lead wire guide which extends substantially perpendicularly from a bottom of the lead wire through path, and at least two of the plurality of lead wires are crossed with each other between the hook groove and a connection portion of the circuit board with respect to the plurality of lead wires, so that at least one second lead wire inhibits displacement of a first lead wire, which is aligned closest to the lead wire through path out of the plurality of lead wires accommodated in the lead wire guide, to a direction of being disengaged from the lead wire through path.

According to the above configuration, the second lead wire(s), which is(are) crossed with the first lead wire aligned closest to the lead wire through path between the circuit board and the hook groove, inhibit(s) displacement of the first lead wire to the direction of being disengaged from the lead wire through path. Therefore, disengagement of the lead wire from the hook groove can be prevented in such a simple method with no necessity for the application of an adhesive agent or an adhesive tape to block an opening of the hook groove.

Further, according to another preferred embodiment of the present invention, there is provided a method for drawing out a plurality of lead wires which are connected to a circuit board of a cooling fan unit, wherein the cooling fan unit has a hook groove locking the lead wires and being formed in a wall of a housing in a direction of drawing out the lead wires, and the hook groove has a lead wire through path which extends substantially perpendicularly from an end edge of the wall of the housing and a lead wire guide which extends substantially perpendicularly from a bottom of the lead wire through path, and when the plurality of lead wires are inserted one by one into the lead wire through path and are accommodated to be aligned in one line in the lead wire guide, at least two of the plurality of lead wires are crossed with each other between the hook groove and a connection portion of the circuit board with respect to the plurality of lead wires, so that at least one second lead wire inhibits displacement of a first lead wire, which is aligned closest to the lead wire through path out of the plurality of lead wires accommodated in the lead wire guide, to a direction of being disengaged from the lead wire through path.

According to the above process, the second lead wire(s), which is(are) crossed with the first lead wire aligned closest to the lead wire through path between the circuit board and the hook groove, inhibit(s) displacement of the first lead wire to the direction of being disengaged from the lead wire through path. Therefore, disengagement of the lead wire from the hook groove can be prevented in such a simple method with no necessity for the application of an adhesive agent or an adhesive tape to block an opening of the hook groove.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 8A and 8B are views of a structure for drawing out lead wires in a conventional cooling fan unit, while FIG. 8A is a bottom view of the cooling fan unit seen from a side of a base in a direction of a central axis and FIG. 8B is a partially enlarged cross sectional view of an outer wall of a housing of the cooling fan unit seen from a direction of drawing out the lead wires.

DETAILED DESCRIPTION OF PREFERRED EMBODIMENTS

Figure 1:
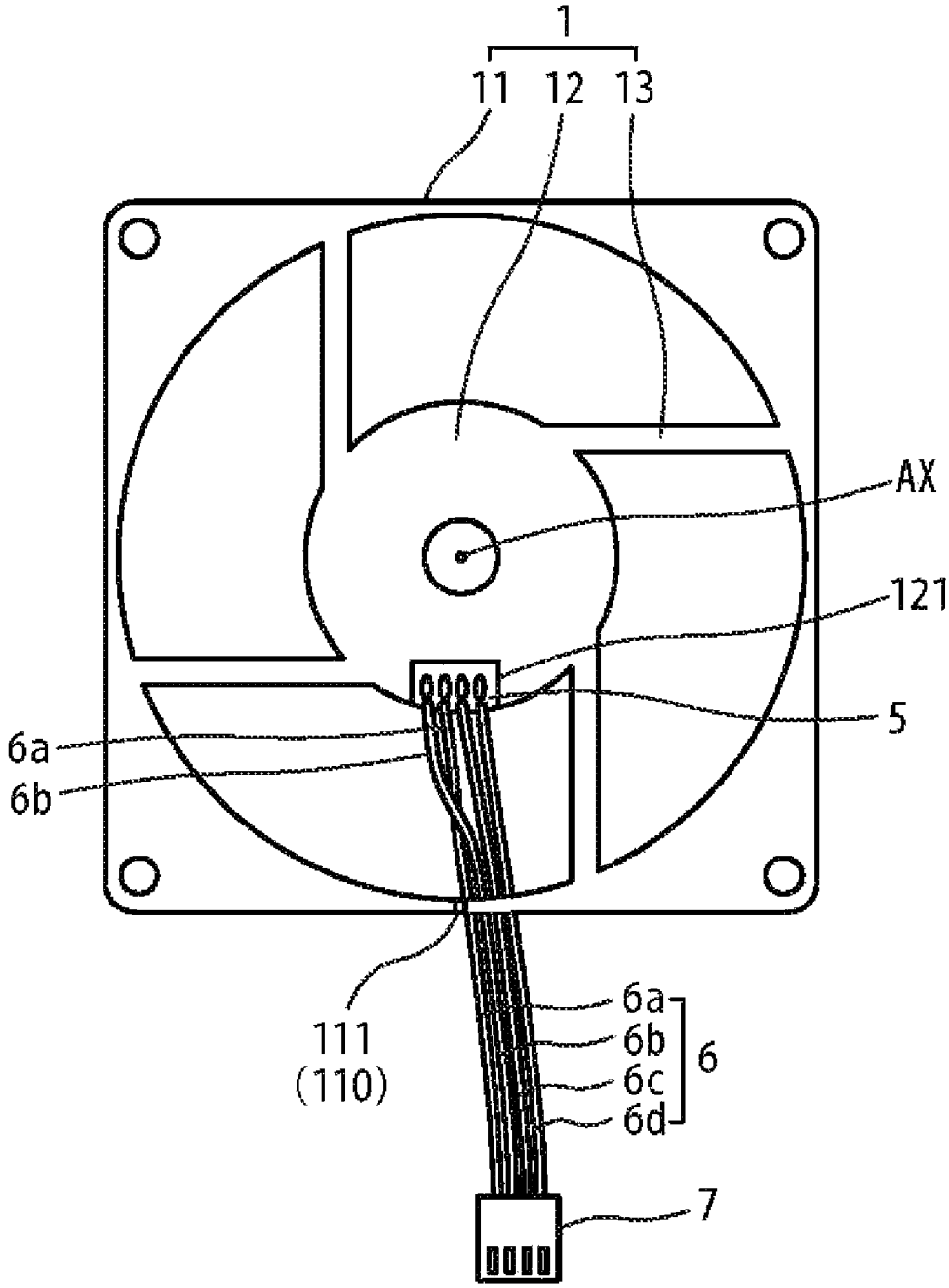
FIG. 1 is a bottom view of a cooling fan unit according to a preferred embodiment of the present invention.

Referring to FIGS. 1 through 7, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel or substantially parallel to a rotation axis, and a radial direction indicates a direction perpendicular or substantially perpendicular to the rotation axis.

Figure 2:
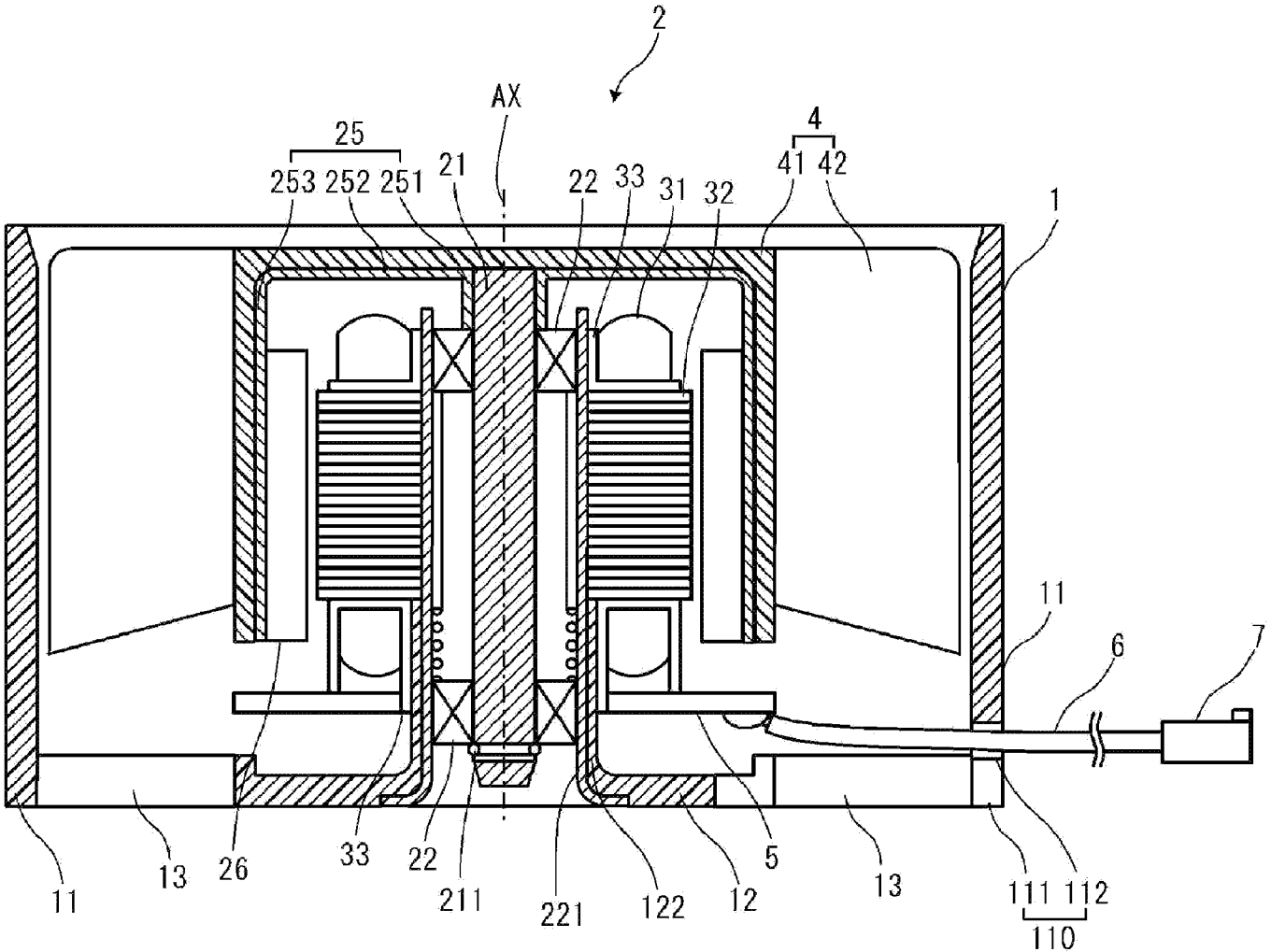
FIG. 2 is a cross sectional view of the cooling fan unit of FIG. 1 cut along a plane including a central axis thereof.

FIG. 1 is a bottom view of a cooling fan unit according to a preferred embodiment of the present invention, and FIG. 2 is a cross sectional view of the cooling fan unit cut along a plane including a central axis AX.

The cooling fan unit according to the present preferred embodiment includes an impeller 4 having a plurality of blades 42 and rotating about the central axis AX to generate airflow, a motor 2 arranged to rotate the impeller 4, a circuit board 5 mounting thereon components configuring a circuit which supplies the motor 2 with drive current, a housing 1 fixing thereto the motor 2 and the circuit board 5 as well as accommodating therein the impeller 4, and a plurality of lead wires 6 connected to the circuit board 5 and drawn out of the housing 1.

The housing 1 is provided with an outer wall 11 having an outline preferably in a substantially square shape and an inner peripheral surface preferably in a substantially circular shape in planar view, a base 12 preferably having a circular or substantially circular shape in planar view and being disposed at a center or approximate center of the outer wall 11, and a plurality of (for example, four in the present preferred embodiment) joining portions 13 joining with each other the outer wall 11 and the base 12. The inner peripheral surface having the circular or substantially circular shape in planar view of the outer wall 11 forms a substantially cylindrical surface which faces an outer peripheral edge of the impeller 4 with a predetermined space therebetween, so as to configure a path of air flowing in the direction of the central axis AX due to rotation of the impeller 4.

The base 12 of the housing 1 is supported at a center within the outer wall 11 by the joining portions 13, and the base 12 retains the motor 2. There stands a cylindrical portion 122 at a center of the base 12 around the central axis AX, in which a pair of bearings 22 are mounted to rotatably support a rotary shaft 21 of the motor 2. The bearings 22 are arranged so as to be spaced apart from each other in the direction of the central axis AX, and are fixed to an inner surface of a cylindrical member 221. The cylindrical member 221 is inserted into the cylindrical portion 122 of the housing 1 and is fixed integrally thereto. Further, there is attached a retentive ring member 211 at a proximal end of the rotary shaft 21. It is noted that the proximal end in the direction of the central axis AX (axial direction) indicates a side provided with the base 12 and the joining portions 13 of the housing 1, while a distal end thereof indicates another side.

There is fixed at the distal end of the rotary shaft 21 a rotor holder 25 preferably made of a magnetic body (such as a galvanized steel plate). The rotor holder 25 has a central portion 251 fixed to the rotary shaft 21, a circular disk portion 252 extending radially outwards into a substantially circular disk shape, and a cylindrical portion 253 bent at an outer periphery of the circular disk part 252 to extend toward the proximal end. The cylindrical portion 253 fixedly attaches and retains onto an inner peripheral surface thereof an outer periphery of a rotor magnet 26 in a substantially cylindrical shape. The rotor magnet 26 is preferably magnetized to have four poles, for example.

The impeller 4 is fixed to an outer peripheral surface of the rotor holder 25. The impeller 4 preferably is a molded resin component, and is provided with an impeller cup 41 covering outer surfaces of the cylindrical portion 253 and the circular disk portion 252 of the rotor holder 25, and the plurality of blades 42 extending radially outwards from an outer peripheral surface of the impeller cup 41 and being circumferentially aligned around the central axis AX.

The motor 2 includes a stator fixed around the central axis AX and a rotor rotating about the central axis AX. The rotor has the rotor magnet 26 that preferably has a substantially cylindrical shape, and the rotor holder 25 provided with the cylindrical portion 253 which retains the outer periphery of the rotor magnet 26. The stator has a stator core 32 provided with coils 31 wound therearound, and the circuit board 5 mounting thereon a driver circuit which supplies the coils 31 with excitation current. The driver circuit is configured by circuit components such as a Hall element, for example, which detects change in magnetic flux due to rotation of the rotor magnet 26 of the motor 2 and a motor driver IC which controls current supplied to the coils 31 in accordance with a signal output from the Hall element.

The stator core 32 has a plurality of teeth extending radially outwards respectively from a plurality of points in the circumferential direction around the central axis AX, and the coils 31 are wound respectively around the teeth. The stator core 32 preferably is made of a plurality of electromagnetic steel plates laminated in the direction of the central axis AX, and each of the electromagnetic steel plates has a circular portion with portions configuring the teeth which respectively extend radially outwards from an outer periphery of the substantially circular portion. A central substantially cylindrical portion of the stator core 32 which is configured by the laminated substantially circular portions of the electromagnetic plates is fitted to an outer periphery of the cylindrical portion 122 of the base 12 of the housing 1, so that the stator including the stator core 32 is fixed to the base 12 of the housing 1.

The coils 31 are respectively wound around the stator core 32 with an insulator 33 (such as a resin insulating material) interposed therebetween. The insulator 33 has a portion on the distal end side in the axial direction and a portion on the proximal end side in the axial direction. The stator core 32 is covered with these portions from the respective sides in the axial direction, and the coils 31 are respectively wound around the covered stator core 32. Radially outer end surfaces of the electromagnetic steel plates are exposed to form an outer peripheral surface of each of the teeth of the stator core 32.

FIG. 1 is a view of a structure for drawing out lead wires according to the present preferred embodiment. The circuit board 5 is partially exposed at a cutout 121 provided in the base 12. The lead wires 6 (6*a* to 6*d*) are soldered to a lead wire connection portion (including solder lands) provided at an area where the circuit board 5 is exposed. There is attached a connector 7 used for connection with an electronic device at other ends of the lead wires 6. The cutout 121 is actually hidden by a plate having a circular or substantially circular disk shape and being affixed to the base 12, while FIG. 1 illustrates a state where the plate is removed.

Figure 3:
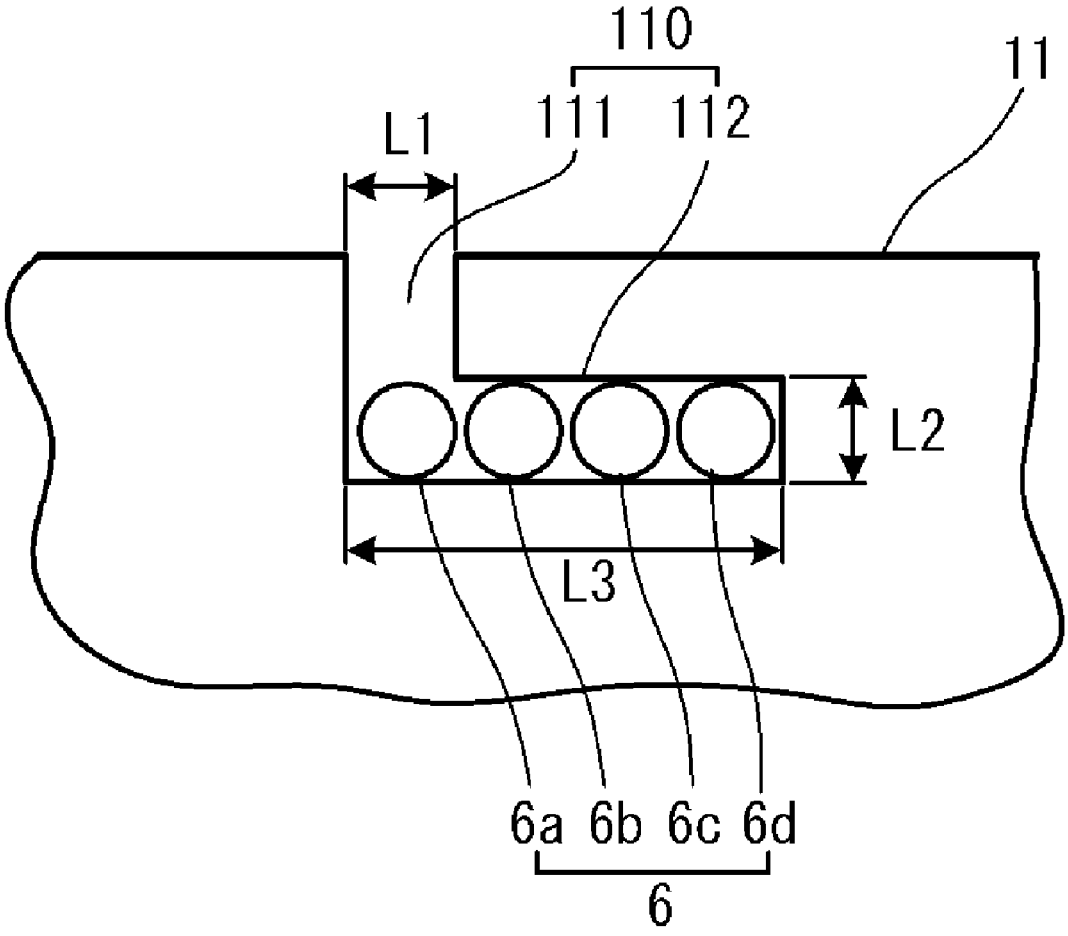
FIG. 3 is a view of a structure for drawing out lead wires according to a preferred embodiment of the present invention, illustrating relationships between a shape, length, and width of a hook groove and a diameter of each of the lead wires.

There is formed a hook groove 110 in the outer wall 11 of the housing 1 in a direction of drawing out the lead wires. As shown in FIG. 3, the hook groove 110 includes a lead wire through path 111 which extends substantially perpendicularly from an end edge of the outer wall 11 and a lead wire guide 112 which extends substantially perpendicularly from a bottom (the lower side in FIG. 3) of the lead wire through path 111. The lead wires 6 are inserted into the lead wire through path 111 sequentially one by one starting with the rightmost wire (6*d*) of FIG. 1 and are accommodated to be aligned in one line in the lead wire guide 112.

Figure 8A:
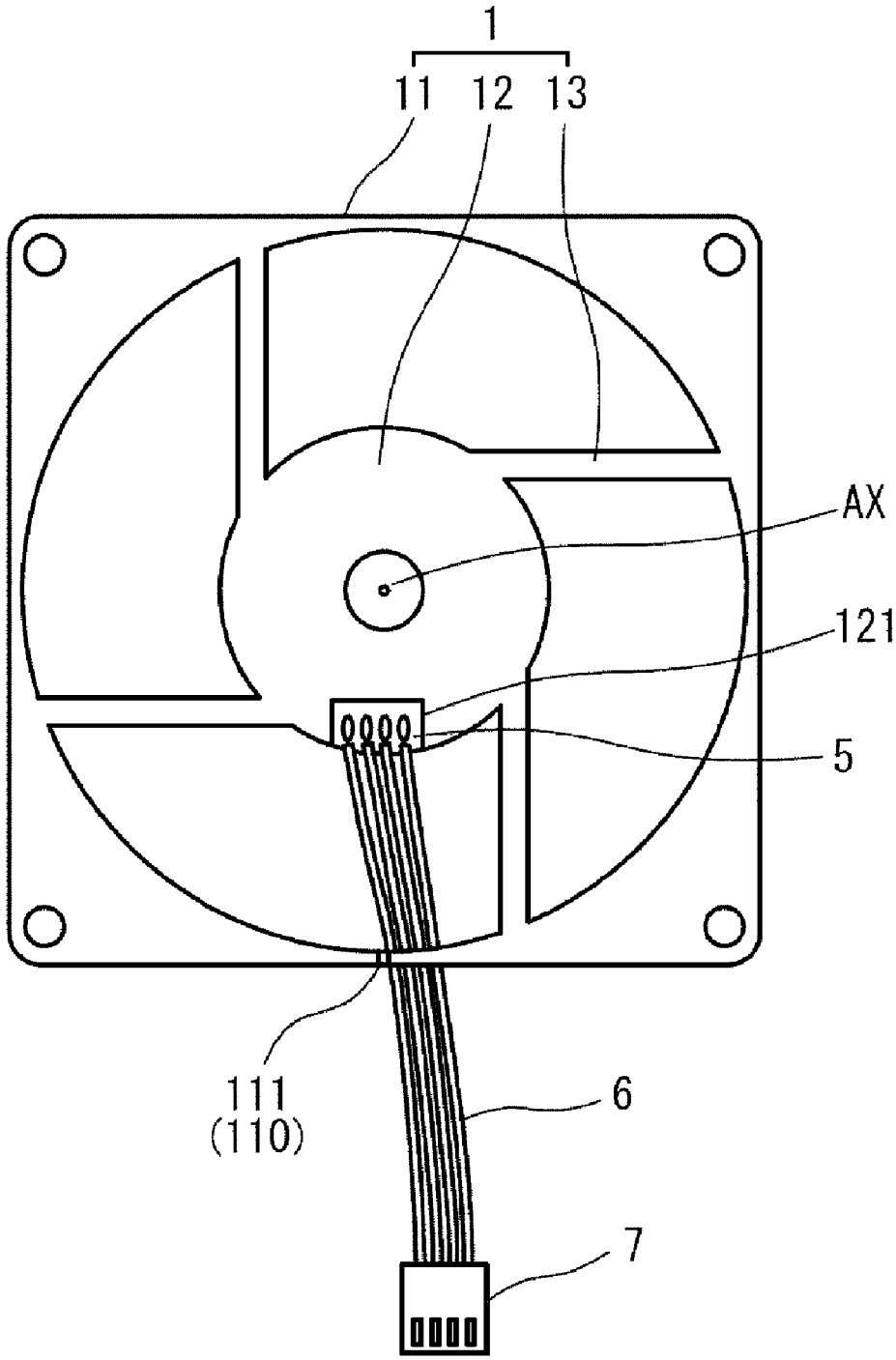
FIG. 8A (Prior Art)
Figure 8B:
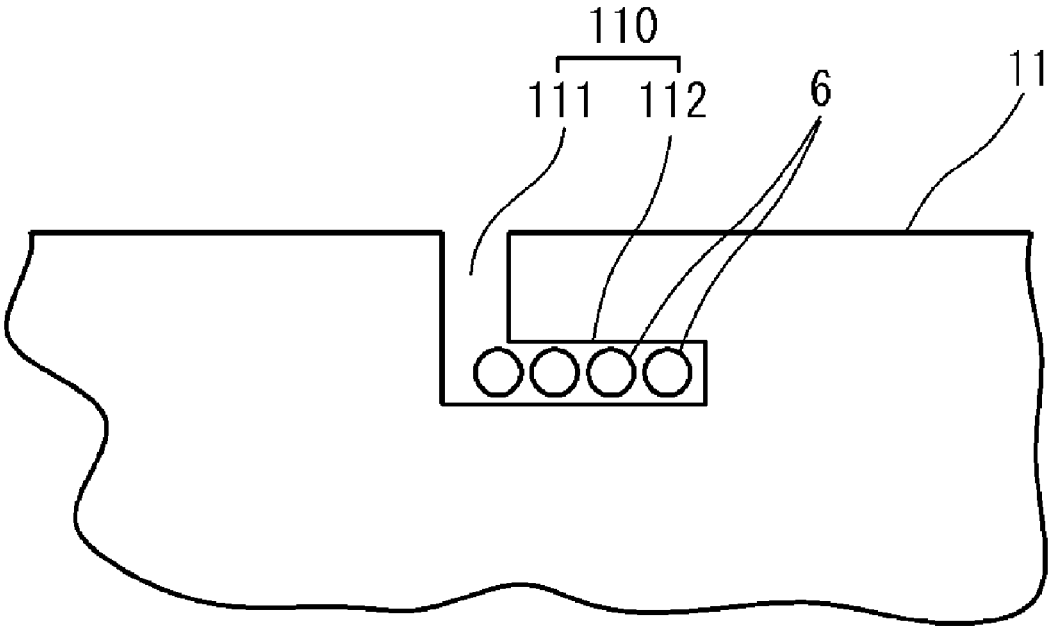
FIG. 8B (Prior Art)

The method for drawing out lead wires according to the present preferred embodiment shown in FIG. 1 is different from the conventional method for drawing out lead wires shown in FIG. 8A in that the first lead wire 6*a* aligned closest to the lead wire through path 111 is crossed with the second lead wire 6*b* aligned next thereto between the hook groove 110 and the connection portion of the circuit board 5 with respect to the lead wires. Specifically, in FIG. 1 showing the bottom view seen from the side of the base 12 of the housing 1, the lead wires 6*a* and 6*b* are crossed with each other between the hook groove 110 and the connection portion of the circuit board 5 with respect to the lead wires such that the second lead wire 6*b* runs over the first lead wire 6*a*.

In an assembly process of an actual cooling fan motor, the connector 7 is attached to first ends of the lead wires 6*a* to 6*d*, there are prepared lead wire processed portions (wire harnesses) of copper wires which are exposed by removing a predetermined length of coating at second ends and are dipped with solder, and then the second ends the four lead wires 6*a* to 6*d* are soldered to the four solder lands aligned at the connection portion of the circuit board 5. In this process, the rightmost lead wire 6*d* and the lead wire 6*c* aligned next thereto of FIG. 1 are soldered to the two solder lands on the right side of the circuit board 5 in this order, while the leftmost lead wire 6*a* and the lead wire 6*b* aligned next thereto are crossed with each other as described above and are soldered to the two solder lands on the left side of the circuit board 5 in an order switched relative to each other. Thereafter, the lead wires 6*a* to 6*d* are inserted sequentially into the lead wire through path 111 and are accommodated to be aligned in one line in the lead wire guide 112.

Alternatively, the four lead wires 6*a* to 6*d* may be firstly inserted sequentially into the lead wire through path 111 and be accommodated to be aligned in one line in the lead wire guide 112, then the ends of the lead wires 6*a* to 6*d* may be soldered to the four solder lands aligned on the circuit board 5. In this case, before soldering, the first lead wire 6*a* is arranged to run under the second lead wire 6*b* between the circuit board 5 and the hook groove 110 (the lead wire through path 111) so that the lead wires 6*a* and 6*b* are crossed with each other.

As described above, the first lead wire 6*a* is crossed with the second lead wire 6*b* between the circuit board 5 and the hook groove 110, so that the second lead wire 6*b* inhibits displacement of the first lead wire 6*a* to a direction of being disengaged from (an opening of) the lead wire through path 111. Therefore, disengagement of the lead wire 6*a* from the hook groove 110 can be prevented in such a simple method, with no necessity for the application of an adhesive agent or an adhesive tape to block the opening (of the lead wire through path 111) of the hook groove 110.

Description is given below, with reference to FIG. 3, to relationships between the shape, length, and width of the hook groove 110 and the diameter (outer diameter) of each of the lead wires 6 (6*a* to 6*d*) in the structure for drawing out lead wires according to the present preferred embodiment. As already described, the hook groove 110 includes the lead wire through path 111 which extends substantially perpendicularly from the end edge of the outer wall part 11 of the housing 1 and the lead wire guide 112 which extends substantially perpendicularly from the bottom (the lower side in FIG. 3) of the lead wire through path 111.

Firstly, the lead wire through path 111 has a width L1 which is larger than a diameter R of the lead wire 6 (expressed as L1>R). In a case where such a dimensional relationship is established, the effect of preventing disengagement of the lead wire 6*a* is increased by the second lead wire 6*b* crossed with the first lead wire 6*a*. As a result, disengagement of the lead wire 6*a* from the hook groove 110 can be prevented with no necessity for application of an adhesive agent or an adhesive tape to the lead wire through path 111.

Secondly, the lead wire guide 112 has a width L2 that is perpendicular to a longitudinal direction thereof, which is preferably smaller than approximately double of the diameter R of the lead wire 6 (expressed as L2<2×R). This dimensional relationship is a first condition for the lead wires 6*a* to 6*d* inserted sequentially into the lead wire through path 111 to be aligned in one line along the longitudinal direction of the lead wire guide 112. On the other hand, in a case where the width L2 is larger than the double of the diameter R of the lead wire 6, the lead wires 6*a* to 6*d* may not be alined in one line. In such a case, the lead wires 6*a* and 6*b* may be switched with each other in the longitudinal direction and may not be crossed with each other, resulting in that the structure for drawing out lead wires according to the present preferred embodiment may not be effective for prevention of disengagement of the lead wire 6*a* from the hook groove 110.

Thirdly, The lead wire guide 112 has a longitudinal length L3 which is larger than a multiplication product of the diameter R of each of the lead wires 6*a* to 6*d* and the number of lead wires (for example, preferably four in the present preferred embodiment) (expressed as L3>4×R according to the present preferred embodiment). This dimensional relationship is a second condition for the four lead wires 6*a* to 6*d* inserted sequentially into the lead wire through path 111 of the hook groove 110 to be aligned in one line along the longitudinal direction of the lead wire guide 112. On the other hand, in a case where the length L3 of the lead wire guide 112 is smaller than the multiplication product of the diameter R of each of the lead wires 6*a* to 6*d* and the number of lead wires (for example, preferably four in the present preferred embodiment), the lead wire guide 112 may not be able to accommodate all of the lead wires 6*a* to 6*d* in one line and the first lead wire 6*a* may be located in the lead wire through path 111. In such a case, the structure for drawing out lead wires according to the present preferred embodiment may not be effective for prevention of disengagement of the lead wire 6*a* from the hook groove 110.

Figure 4:
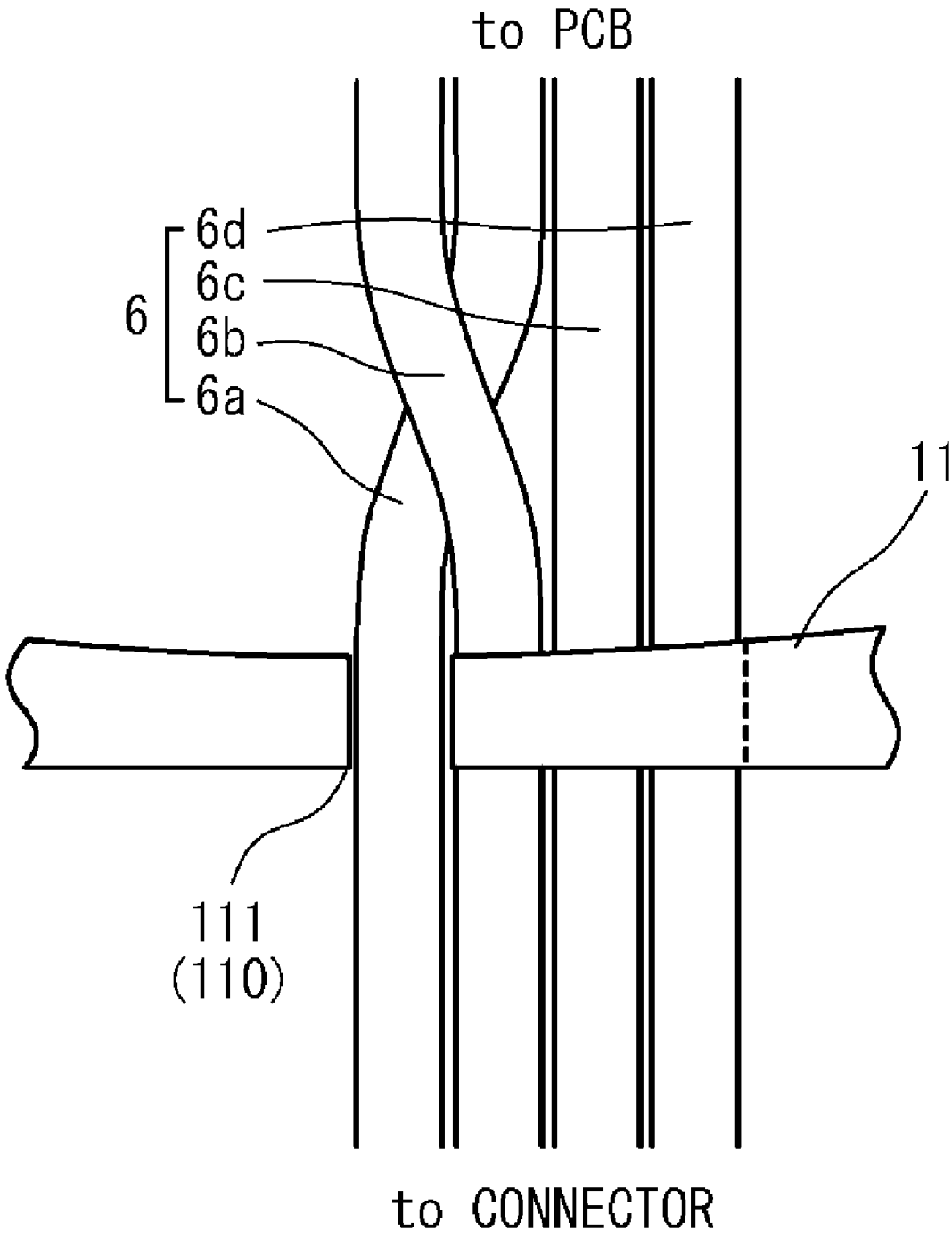
FIG. 4 is an enlarged view of a state of crossed lead wires in a method for drawing out lead wires according to a preferred embodiment of the present invention.
Figure 5:
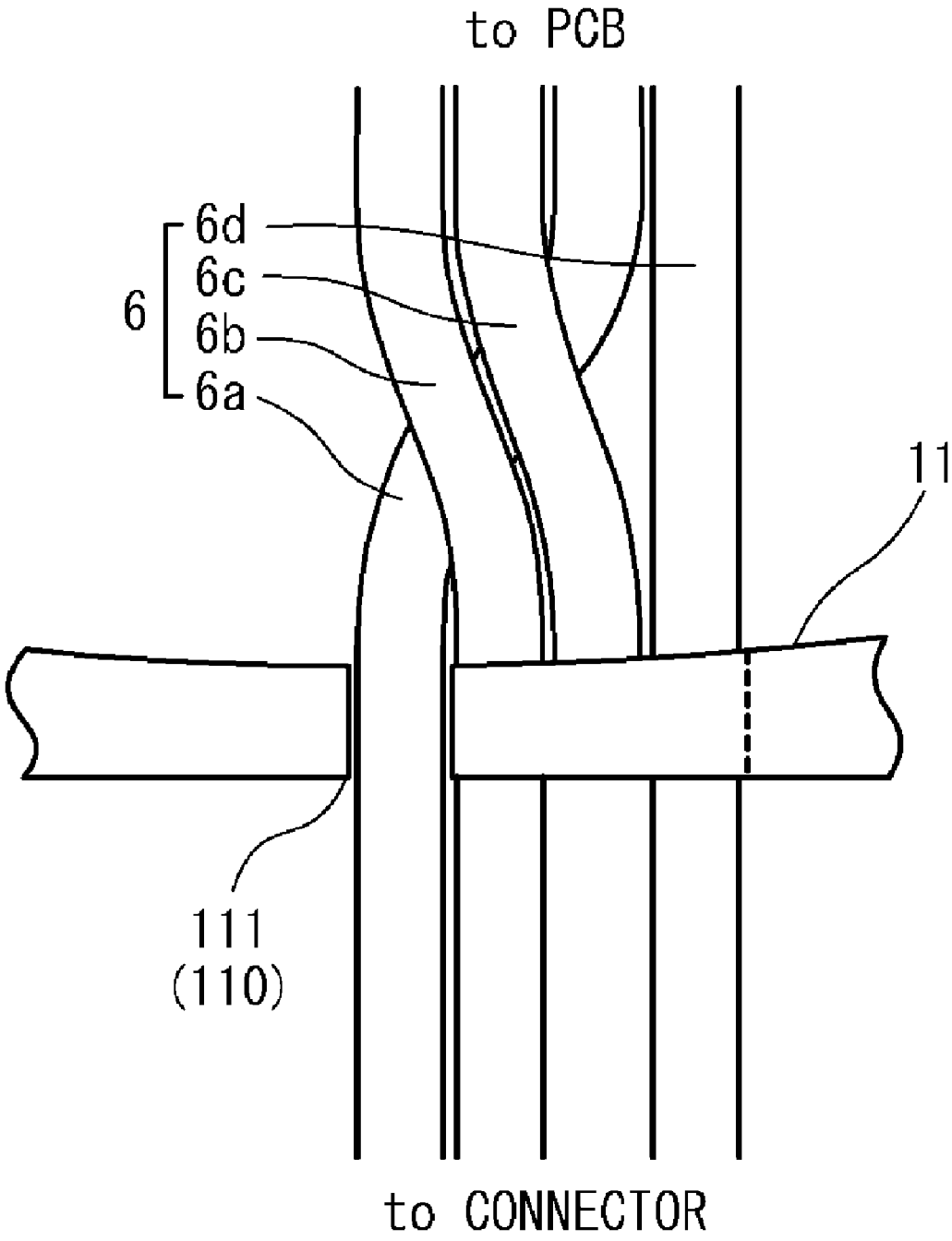
FIG. 5 is an enlarged view of a state of crossed lead wires in a method for drawing out lead wires according to a first preferred modification of the present invention.
Figure 6:
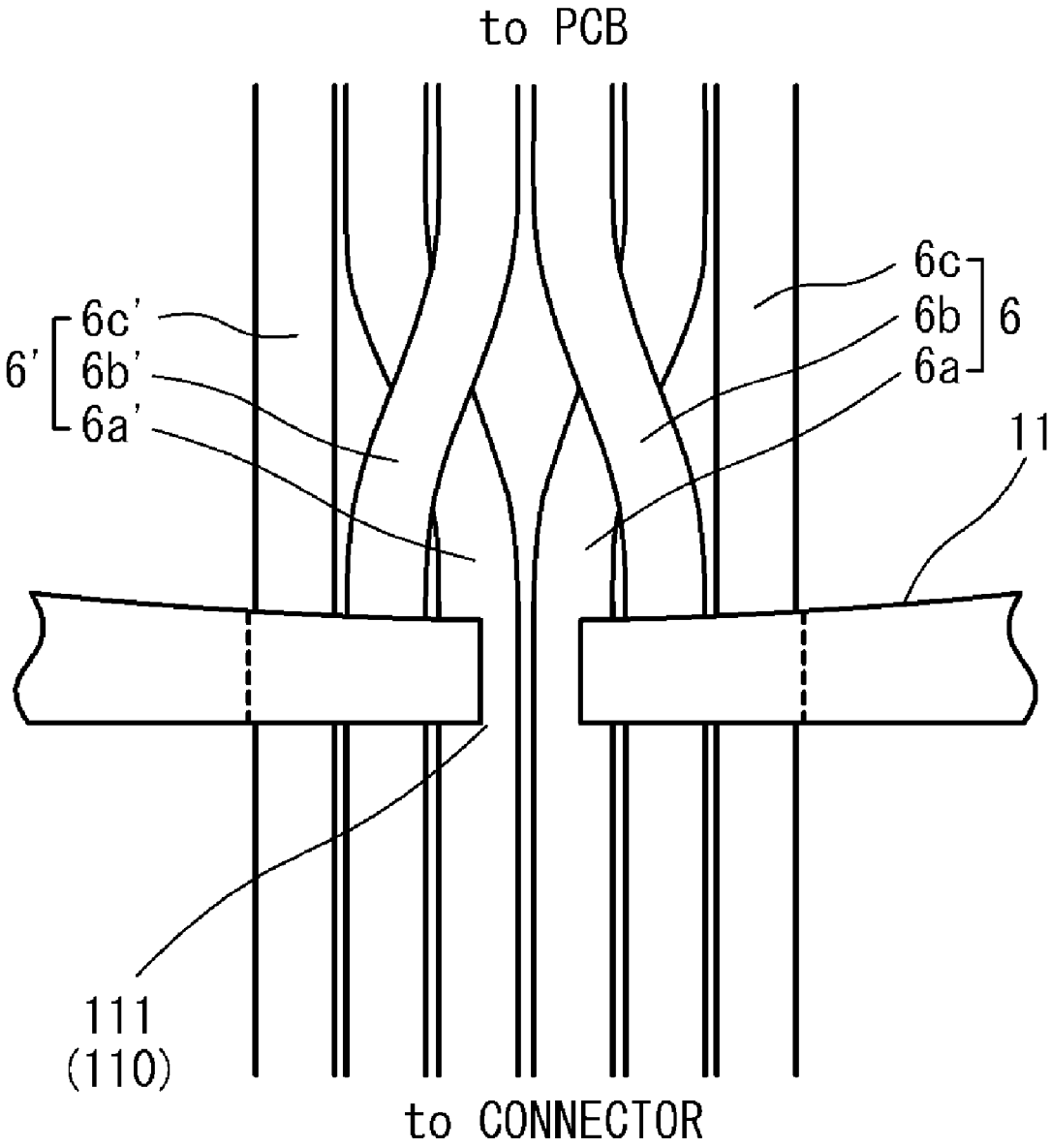
FIG. 6 is an enlarged view of a state of crossed lead wires in a method for drawing out lead wires according to a second preferred modification of the present invention.
Figure 7:
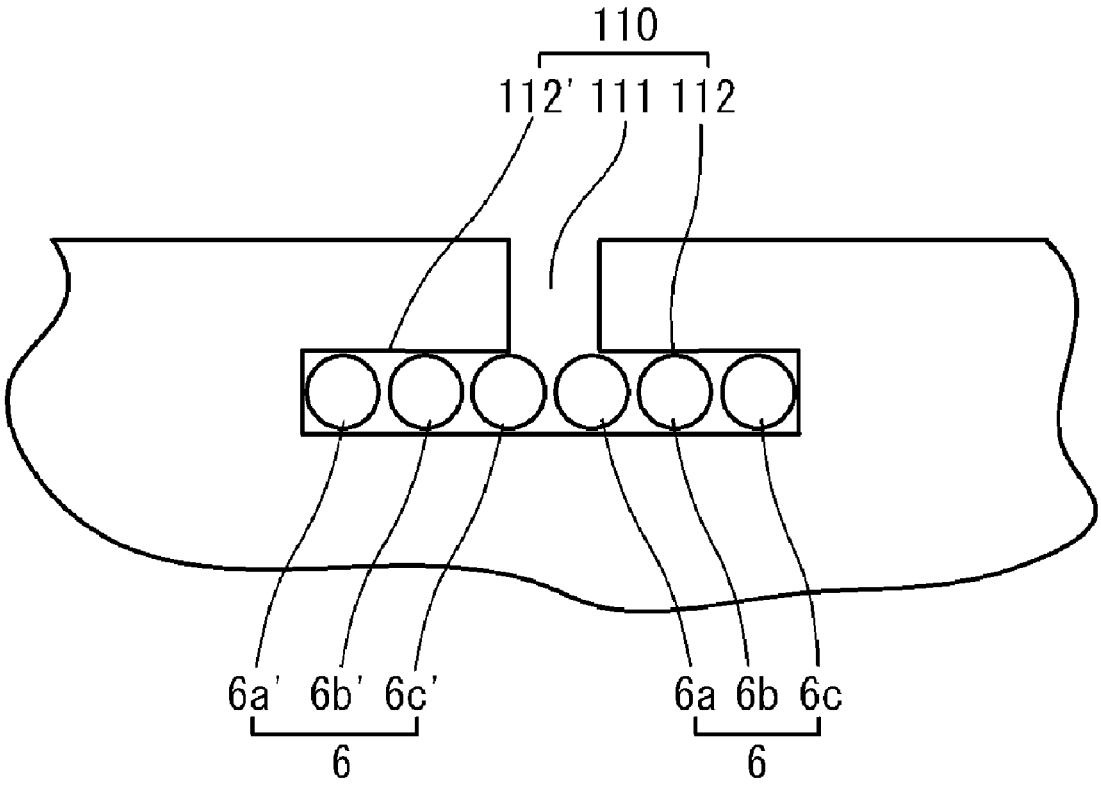
FIG. 7 is a partially enlarged cross sectional view of an outer wall of a housing seen from a direction of drawing out the lead wires in the method for drawing out lead wires according to the second preferred modification of the present invention.

Below described with reference to FIGS. 4 to 7 are methods for drawing out lead wires according to some preferable modifications from the present preferred embodiment. FIG. 4 is an enlarged view of a state of the crossed lead wires 6*a* to 6*d* in the method for drawing out lead wires according to the present preferred embodiment. FIG. 5 is an enlarged view of a state of the crossed lead wires 6*a* to 6*d* in a method for drawing out lead wires according to a first preferred modification. FIG. 6 is an enlarged view of a state of the crossed lead wires 6*a* to 6*d* in a method for drawing out lead wires according to a second preferred modification. FIG. 7 is a partially enlarged cross sectional view of the outer wall part of the housing seen from the direction of drawing out the lead wires in the method for drawing out lead wires according to the second preferred modification.

In the above described preferred embodiment, as shown in FIGS. 1 and 4, the first lead wire 6*a* aligned closest to the lead wire through path 111 are crossed with the second lead wire 6*b* aligned next thereto between the circuit board 5 and the hook groove 110. However, the method for drawing out lead wires according to the present invention is not limited to such a configuration. Alternatively, the first lead wire 6*a* aligned closest to the lead wire through path 111 may be crossed with at least one second lead wire such that the second lead wire(s) inhibit(s) displacement of the first lead wire 6*a* to the direction of being disengaged from the hook groove 110.

For example, as shown in FIG. 5, the first lead wire 6*a* may be arranged to run under both the second lead wire 6*b* and the third lead wire 6*c* aligned next thereto such that the first lead wire 6*a* is crossed with the second and third lead wires 6*b* and 6*c*. In comparison to the drawing out method with the two lead wires 6*a* and 6*b* being crossed as shown in FIG. 4, in the drawing out method with the three lead wires 6*a*, 6*b* and 6*c* being crossed as shown in FIG. 5, both of the second and third lead wires 6*b* and 6*c* can inhibit displacement of the first lead wire 6*a* aligned closest to the lead wire through path 111 to the direction of being disengaged from the lead wire through path 111. As a result, it is possible to more securely prevent disengagement of the lead wire 6*a* from the hook groove 110.

Although not shown, both of the first and second lead wires 6*a* and 6*b* may be arranged to run under the third lead wire 6*c* such that the first and second lead wires 6*a* and 6*b* are crossed with the third lead wire 6*c*. In this case, the third lead wire 6*c* inhibits displacement of the first lead wire 6*a* aligned closest to the lead wire through path 111 to the direction of being disengaged from the lead wire through path 111, so that it is possible to prevent disengagement of the lead wire 6*a* from the hook groove 110.

As shown in FIGS. 6 and 7, the present invention is also applicable to the hook groove 110 having two lead wire guides 112 and 112' extending respectively to opposite directions (to the left and right sides in the drawings) from the bottom (the lower side in FIG. 7) of the lead wire through path 111. In the modification shown in the drawings, the two lead wire guides 112 and 112' preferably accommodate respectively three lead wires 6*a* to 6*c* and three lead wires 6*a'* to 6*c'*, six in total, for example. In the respective lead wire guide parts 112 and 112', the first lead wire 6*a* (6*a'*) aligned closest to the lead wire through path 111 is crossed with the lead wire 6*b* (6*b'*) aligned next thereto between the circuit board 5 and the hook groove 110, thereby preventing disengagement of the first lead wire 6*a* (6*a'*) from the hook groove 110. Needless to say, the first lead wire aligned closest to the lead wire through path 111 may be crossed with the second lead wire in only one of the two lead wire guide parts 112 and 112', so as to prevent disengagement of the first lead wire from the hook groove 110.

Above described are the preferred embodiments and preferred modifications of the present invention. However, the present invention is not limited thereto but can be embodied in various modes. While the above described preferred embodiments and modifications are directed to the cooling fan unit of an axial flow type, the present invention is also applicable to a cooling fan unit of a centrifugal type. Moreover, the present invention is not specifically limited by the number of lead wires and the shapes of grooves in the lead wire through path and the lead wire guide.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A cooling fan unit comprising:

an impeller including a plurality of blades arranged to rotate to generate an airflow;

a motor arranged to rotate the impeller about an axial direction;

a circuit board including components mounted thereon configuring a circuit to supply the motor with a drive current;

a housing fixing thereto the motor and the circuit board and accommodating the impeller; and a plurality of lead wires connected to the circuit board and drawn out of the housing; wherein a hook groove which is arranged to secure the plurality of lead wires is defined in a wall of the housing so as to extend in a direction in which the plurality of lead wires are drawn out from the circuit board;

the hook groove includes a lead wire through path in an axial top surface of the wall of the housing which extends or substantially extends longitudinally in the direction in which the plurality of lead wires are drawn out from the circuit board from an inner end surface to an outer end surface of the wall of the housing and a lead wire guide which extends substantially perpendicularly from an axially lower portion of the lead wire through path;

at least two of the plurality of lead wires are arranged to cross with each other at a position between the hook groove and a connection portion of the circuit board with respect to the direction in which the plurality of lead wires are drawn out from the circuit board, so that at least one second lead wire of the at least two of the plurality of lead wires inhibits a displacement of a first lead wire of the at least two of the plurality of lead wires, which is aligned closest to the lead wire through path out of all of the plurality of lead wires accommodated in the lead wire guide, in a direction at which the first lead wire of the at least two of the plurality of lead wires becomes disengaged from the lead wire through path; and portions of the plurality of lead wires located at the position between the hook groove and the connection portion of the circuit board are arranged to overlap with the impeller in a radial direction such that substantially an entirety of the portions of the plurality of lead wires located at the position between the hook groove and the connection portion of the circuit board are exposed to the airflow generated by the impeller.

2. The cooling fan unit according to claim 1, wherein the second lead wire is aligned next to the first lead wire.

3. The cooling fan unit according to claim 1, wherein the plurality of lead wires are connected respectively to a plurality of solder lands which are provided in one line on the circuit board, and are arranged to be aligned in one line in the lead wire guide of the hook groove.

4. The cooling fan unit according to claim 1, wherein the lead wire through path of the hook groove includes an opening in the axial top surface of the wall with a width which is larger than a diameter of one of the plurality of the lead wires.

5. The cooling fan unit according to claim 1, wherein the lead wire guide of the hook groove includes a width in the axial direction, which is smaller than about two times a diameter of one of the plurality of the lead wires.

6. The cooling fan unit according to claim 1, wherein the lead wire guide of the hook groove includes a length that is perpendicular or substantially perpendicular to the longitudinal and axial directions thereof, which is larger than a multiplication product of a diameter of one of the plurality of the lead wires and the number of the plurality of the lead wires.

7. The cooling fan unit according to claim 1, wherein the hook groove includes two lead wire guides which extend respectively in opposite directions from the axial lower portion of the lead wire through path.

8. The cooling fan unit according to claim 1, wherein the number of the plurality of lead wires is at least two.

9. The cooling fan unit according to claim 1, wherein the number of the plurality of lead wires is four.

10. The cooling fan unit according to claim 1, wherein the first lead wire is arranged to run under both the second lead wire and a third lead wire of the plurality of lead wires aligned next to the second lead wire such that the first lead wire is crossed with the second and third lead wires.

11. The cooling fan unit according to claim 1, wherein the first and second lead wires are arranged to run under a third lead wire of the plurality of lead wires aligned next to the second lead wire such that the first and second lead wires are crossed with the third lead wire.

12. A method for drawing out a plurality of lead wires which are connected to a circuit board of a cooling fan unit, wherein the cooling fan unit includes a hook groove locking the lead wires and being defined in an axial top surface of a wall of a housing in a direction of drawing out the lead wires in a radical direction, and the hook groove including a lead wire through path which extends or substantially extends longitudinally in the direction in which the plurality lead wires are drawn out from the circuit board from an inner end surface to an outer end surface of the wall of the housing and a lead wire guide which extends substantially perpendicularly from an axially lower portion of the lead wire through path, the method comprising the steps of:

inserting the plurality of lead wires one by one into the lead wire through path so as to be aligned in one line in the lead wire guide; and crossing at least two of the plurality of lead wires with each other between the hook groove and a connection portion of the circuit board, so that at least one second lead wire of the at least two of the plurality of lead wires inhibits displacement of a first lead wire of the at least two of the plurality of lead wires, which is aligned closest to the lead wire through path out of the plurality of lead wires accommodated in the lead wire guide, in a direction at which the first lead wire of the at least two of the plurality of lead wires becomes disengaged from the lead wire through path; wherein portions of the plurality of lead wires located at the position between the hook groove and the connection portion of the circuit board are arranged to overlap with an impeller of the cooling fan unit in the radial direction such that substantially an entirety of the portions of the plurality of lead wires located at the position between the hook groove and the connection portion of the circuit board are exposed to an airflow generated by the impeller.

13. The method according to claim 12, wherein the second lead wire is aligned next to the first lead wire.

14. The method according to claim 12, wherein in the step of crossing, the first lead wire is arranged to run under both the second lead wire and a third lead wire of the plurality of lead wires aligned next to the second lead wire such that the first lead wire is crossed with the second and third lead wires.

15. The method according to claim 12, wherein in the step of crossing, the first and second lead wires are arranged to run under a third lead wire of the plurality of lead wires aligned next to the second lead wire such that the first and second lead wires are crossed with the third lead wire.

16. The method according to claim 12, wherein the plurality of lead wires are connected respectively to a plurality of solder lands which are provided in one line on the circuit board, and are arranged to be aligned in one line in the lead wire guide of the hook groove.

17. The method according to claim 12, wherein the lead wire through path of the hook groove includes an opening in the axial top surface of the wall with a width which is larger than a diameter of the lead wire.

18. The method according to claim 12, wherein the lead wire guide of the hook groove includes a width in the axial direction, which is smaller than about two times a diameter of one of the plurality of the lead wires.

19. The method according to claim 12, wherein the lead wire guide of the hook groove includes a length that is perpendicular or substantially perpendicular to the longitudinal and axial directions thereof, which is larger than a multiplication product of a diameter of one of the plurality of the lead wires and the number of the plurality of the lead wires.

20. The method according to claim 12, wherein the hook groove includes two lead wire guides which extend respectively in opposite directions from the axial lower portion of the lead wire through path.

21. The method according to claim 12, wherein the steps of inserting and crossing are performed at substantially the same time.

22. The cooling fan unit according to claim 1, wherein the position at which the at least two of the plurality of wires are crossed is substantially at a midpoint of a distance between the hook groove and the connection portion.

23. The method according to claim 12, wherein the position at which the at least two of the plurality of wires are crossed is substantially at a midpoint of a distance between the hook groove and the connection portion.

* * * * *